US006575595B1

(12) United States Patent
Wu

(10) Patent No.: US 6,575,595 B1
(45) Date of Patent: Jun. 10, 2003

(54) ELECTRICAL CIRCUIT DISTRIBUTION STRUCTURE FOR DECORATIVE LIGHTING STRING

(76) Inventor: Jeng-Shyong Wu, No. 14, Alley 1, Lane 326, Shyr-Piin Road, Hsin-Chu City (TW)

( * ) Notice: Subject to any disclaimer, the term of this patent is extended or adjusted under 35 U.S.C. 154(b) by 0 days.

(21) Appl. No.: 09/578,325

(22) Filed: May 24, 2000

(51) Int. Cl.[7] ..... F21S 13/14; F21V 21/00

(52) U.S. Cl. ..... 362/249; 362/806; 362/252; 362/123; 362/391

(58) Field of Search ..... 362/249, 806, 362/252, 123, 396, 227, 391

(56) References Cited

U.S. PATENT DOCUMENTS 5,601,361 A 2/1997 Lawrence
5,944,408 A * 8/1999 Tong et al. ..... 362/252
6,126,298 A * 10/2000 Wu ..... 362/252
6,158,878 A * 12/2000 Lawrence ..... 362/238
6,184,629 B1 * 2/2001 Won ..... 362/123
6,302,562 B1 * 10/2001 Wu ..... 362/252
6,390,645 B1 * 5/2002 Wu ..... 362/227
6,494,592 B1 * 12/2002 Rahman ..... 362/249

* cited by examiner

*Primary Examiner*—Thomas M. Sember
(74) *Attorney, Agent, or Firm*—McGlew and Tuttle, P.C.

(57) ABSTRACT

The present invention provides an electrical circuit distribution structure and a method for forming an electrical circuit distribution structure for a decorative lighting string, wherein non-electrical connectors being formed by the ropes, said rope formed from filaments having wound and twisted into a small bundle line, then said lines being wound and twisted into a large rope, said twisted rope to use a reversing force to form an open part at intervals to accept electrical conductors with the lamp bulbs, the lamp bases or lamp holders to pass through its open part, while an electrical conductor intersected from the open part. As a rebound force makes the open part be shrunken so that electrical conductors with the lamp bulbs, the lamp bases or lamp holders are fixed together whereby to form various shapes in the safe lighting string.

39 Claims, 16 Drawing Sheets

ELECTRICAL CIRCUIT DISTRIBUTION STRUCTURE FOR DECORATIVE LIGHTING STRING

BACKGROUND OF THE INVENTION

A conventional lamp socket device in a Christmas lighting string is consisting of a lamp bulb, lamp base or lamp holder, multiple electrical conductors, receptacles or flasher control, wherein the electrical conductors can be single or double or more than two wind into an electrical circuit. The contribution conductors can be formed in one, two or more than two electrical conductors. In general, it is to use said electrical conductors to be wound in the trees in the past. The recent development is to form a net light. The conventional use is a lamp holder being equipped with a fastener or to use a fastening ring to fix the electrical conductors on the lamp holder; or to use fastening ring to bundle the multiple electrical conductors together. In the structures of U.S. Pat. No. 5,601,361, it discloses flexible non-electrical connectors having spaced eyelets to hold light string lamps, due to non-electrical line formed by a flexible material and easy to enlarge the eyelets by pulling the line so that the light string lamps are easily released from the eyelets. However, such structures are still unable to reach an ideal effect. The present invention is an improvement in the defects of the conventional products. It is to use non-electrical connectors, in which their size, color and appearance are similar to the electrical conductors. Said non-electrical connectors are wound, twisted and knotted with the electrical conductors or at the end of the non-electrical connectors sintered by heat and limited to the position of the lamp bases or lamp holders at interval. Thus, it is able to form every appearance, design or words so as to obtain a decorative effect.

SUMMARY OF THE INVENTION

Accordingly, it is an object of the present invention to provide an electrical circuit distribution structure for a Christmas lighting string to form a certain appearance, design or words and to obtain a decorative effect.

Another object is to provide with the use of non-electrical connectors being simultaneously or individually fixed with electrical conductors by making knots or at end of non-electrical connectors to be sintered by heat so as form a certain appearance, design or words and to obtain a decorative effect.

A further object is to provide a method for forming an electrical circuit distribution structure for a decorative lighting string, in which non-electrical connectors are formed by the ropes, said rope are formed from filaments which are wound and twisted into a small bundle line, then said lines are wound and twisted into a large rope. The non-electrical connector and one of electrical conductor are wound and twisted together, and said non-electrical connector is extending along a same direction as done of said one of electrical conductor.

A still further object is to provide a method for forming an electrical circuit distribution structure for a decorative lighting string, wherein non-electrical connectors being formed by the ropes, said rope formed from filaments having wound and twisted into a small bundle line, then said lines being wound and twisted into a large rope, said twisted rope to use a reversing force to form an open part at intervals to accept electrical conductors with the lamp bulbs, the lamp bases or lamp holders to pass through its open part, while an electrical conductor intersected from the open part. As a rebound force makes the open part be shrunken so that electrical conductors with the lamp bulbs, the lamp bases or lamp holders are fixed together whereby to form various shapes in the safe lighting string.

Other objects and features will become apparent when the description of preferred embodiments is taken in conjunction with the annexed drawings.

BRIEF DESCRIPTION OF THE DRAWINGS

FIG. 11A is a partial diagram of distribution.

DETAILED DESCRIPTION OF THE PREFERRED EMBODIMENTS

Figure 1:
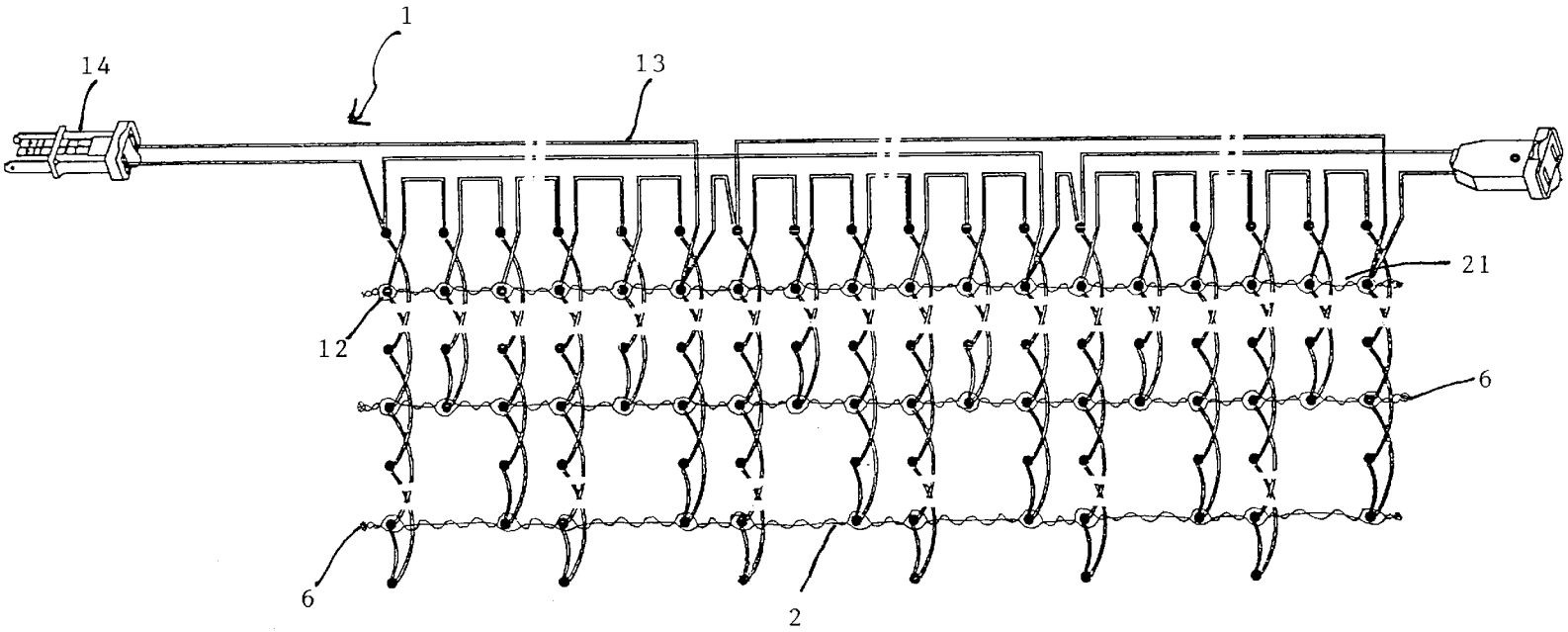
FIG. 1 is an embodiment of an electrical circuit distribution structure in rectangular or square unit to form a large design of the present invention.

For the explanatory purpose, same reference numbers are used to indicate the same parts of components in the drawings.

Referring now to the drawings and in particular to FIG. 1, it is an embodiment of an electrical circuit distribution structure of the present invention, said structure comprising a lighting string 1, a plurality of lamp bases or holders 12, a plurality of electrical conductors 13 and attachment plug 14. It is to use non-electrical connectors 21 which are not to wind with the electrical conductors, said non-electrical connectors 21 with multiple bundle and twisted ropes, said rope formed with filaments having wound and twisted into a small bundle line, then said lines being wound and twisted into a large line of twisted rope to form non-electrical connectors 21 and an end of said rope making a knot or sintered with heat to prevent said non-electrical connectors 21 from loosing, at the horizontal direction making the knots 4 between the lamp base or lamp holder 12, or a twisted rope (non-electrical connectors) to use a reversing force to form an open part (not shown) at intervals to accept electrical conductors 13 with the lamp bulbs, the lamp bases or lamp holders 12 to pass through its open part, while an electrical conductor 13 intersected from the open part, due to a rebound force to make the open part be shrunken so that electrical conductors 13 with the lamp bulbs, the lamp bases or lamp holders 12 being fixed together whereby to form various shapes in the safe lighting string.

Figure 2:
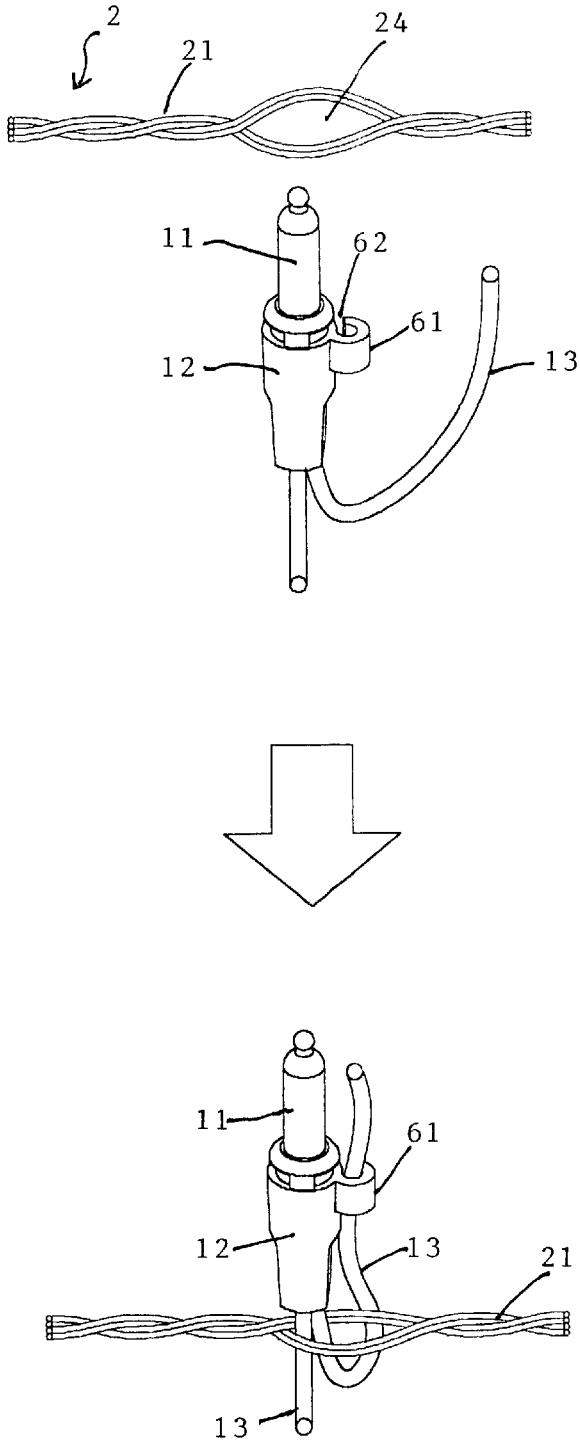
FIG. 2 is an embodiment of a method for assembling a lamp base or a lamp holder with non-electrical connectors.

FIG. 2 is an embodiment of a method for assembling a lamp base or a lamp holder with non-electrical connectors. It shows a method for forming an electrical circuit distribution structure for a decorative lighting string, wherein non-electrical connectors being formed by the ropes, said rope formed from filaments having wound and twisted into a small bundle line, then said lines being wound and twisted into a large rope, the combination of non-electrical connectors 21 and electrical conductors 13 to be divided into two parts, the first part being an electrical conductor 13 connect a lamp bulb 11, lamp base or lamp holder 12 with a hook 61 on the upper part, the second part being a non-electrical connector 21 to be wound and twisted with another non-electrical connector 21 to form the twisted ropes 2, the electrical conductors 13 with the lamp bulbs 11, the lamp bases or lamp holders 12 in the first part to pass through the open part 24 of non-electrical connectors 21, an electrical conductor 13 intersected a non-electrical connector 21 from the open part 24, then pass through the hook 61, and the non-electrical connectors 21 due to a rebound force to make the open part 24 be shrunken so that the first part and the second part being fixed together whereby to form a safe lighting string.

Figure 3:
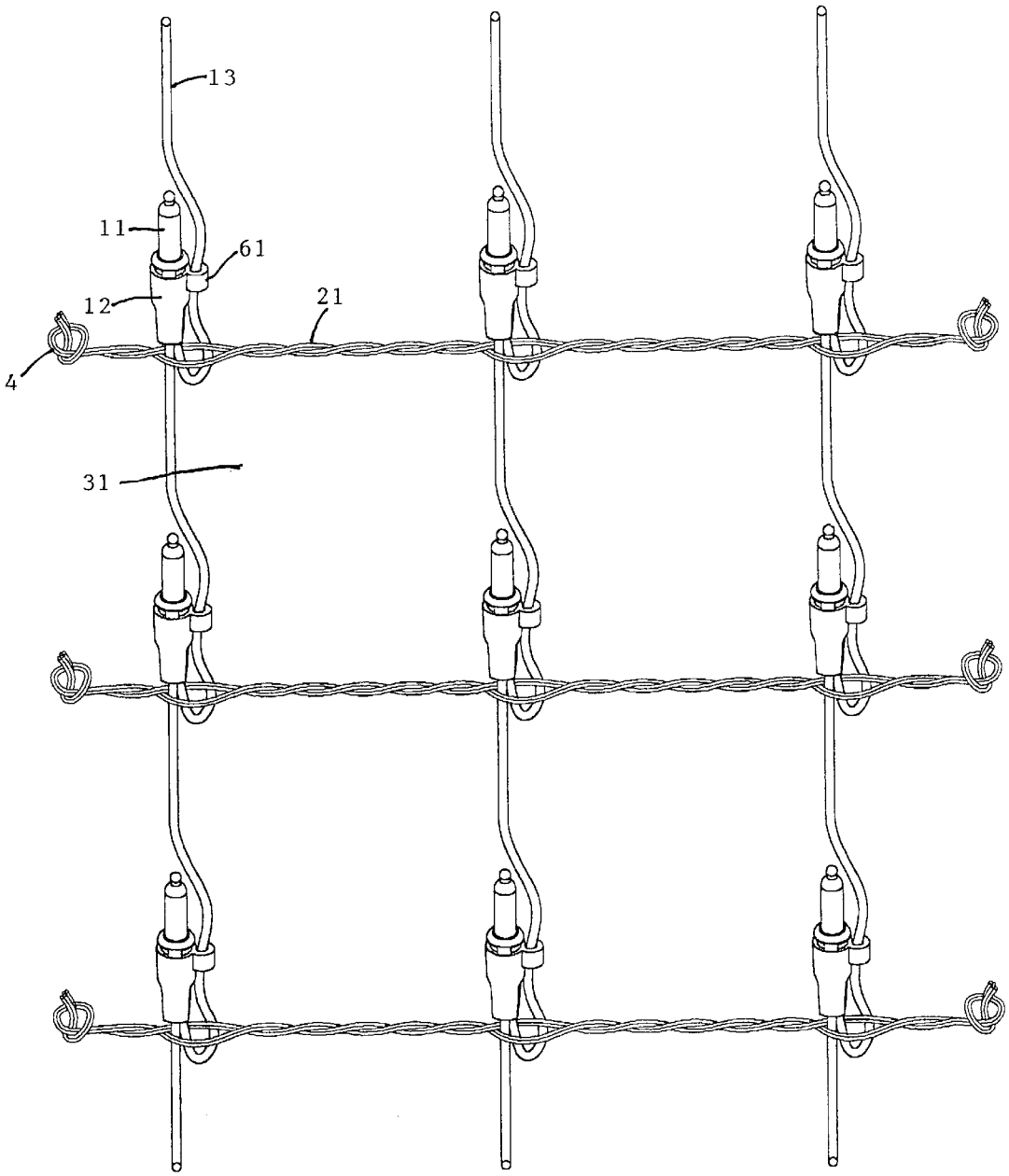
FIG. 3 is an embodiment of an electrical circuit distribution structure in rectangular unit to form a large design of the present invention.

According to the electrical circuit distribution structure in FIG. 3, it shows a method for forming an electrical circuit distribution structure in square shape for a decorative lighting string comprising lamp bulbs 11, lamp bases or lamp holders 12 having a hook 61, multiple electrical conductors 13 and non-electrical connectors 21 formed by multiple bundle and twisted lines, characterized in that the electrical conductors 13 being connected with lamp bulbs 11, lamp bases or lamp holders 12, to form a circuit loop, the combination of non-electrical connectors 21 and electrical conductors 13 are identical with those of in FIG. 2.

Figure 4:
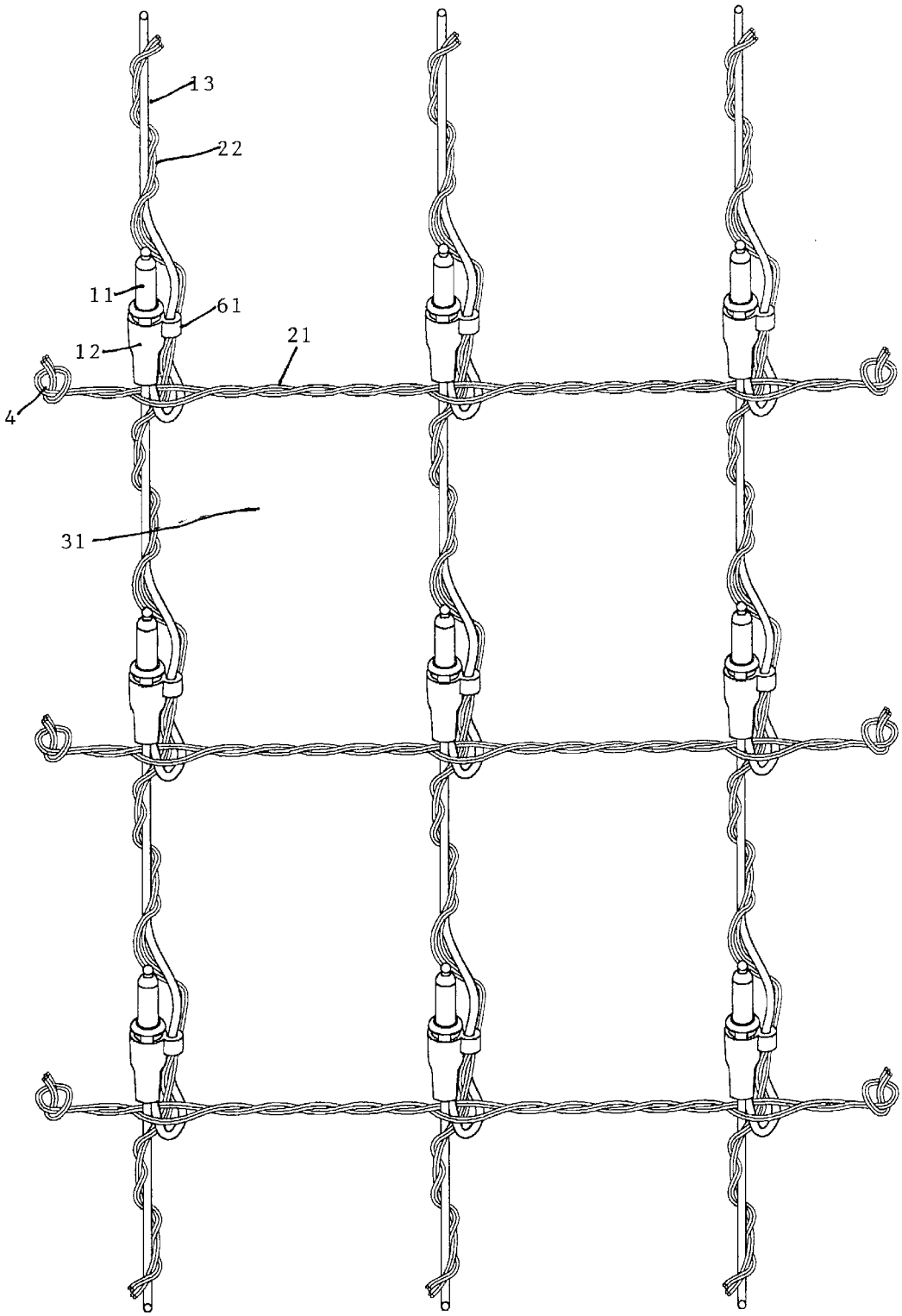
FIG. 4 is another embodiment of an electrical circuit distribution structure in rectangular or square unit to form a large design of the present invention.

According to the electrical circuit distribution structure in FIG. 4, it shows a square structure of a light string, and the formation of non-electrical, connectors is identical with those of in FIG. 2. The combination of non-electrical connectors 21 and electrical conductors 13 is divided into two parts, the first part being an electrical conductor 13 to be wound and twisted with non-electrical connectors 22 to form the twisted lines, the second part being a non-electrical connector 21 to be wound and twisted with non-electrical connector 21 each other to form the twisted non-electrical lines, the electrical conductors 13 with the lamp bases or lamp holders 12 in the first part to be fixed in the hook 61 to pass through the open part of non-electrical connectors 21 so that the first part and the second part being fixed together whereby to form a safe lighting string.

Figure 5:
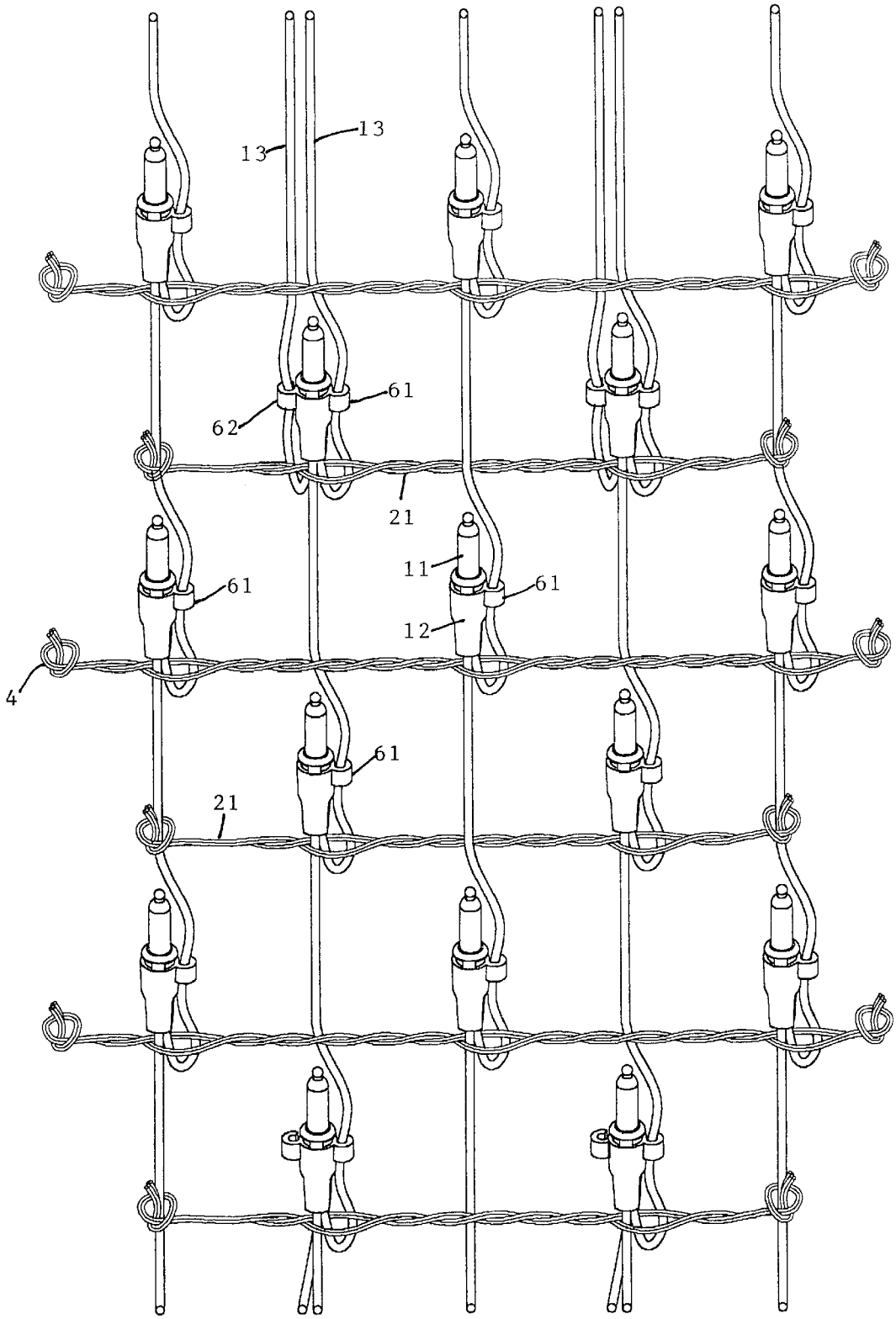
FIG. 5 is a still further embodiment of an electrical circuit distribution structure in rectangular, square or rhombic unit to form a large design of the present invention.

According to the electrical circuit distribution structure in FIG. 5, it shows a method for forming an electrical circuit distribution structure in rhombic shape for a decorative lighting string comprising lamp bulbs 11, lamp bases or lamp holders 12 having a hook 61, multiple electrical conductors 13 and non-electrical connectors 21 formed by multiple bundle and twisted lines, characterized in that the electrical conductors 13 being connected with lamp bulbs 11, lamp bases or lamp holders 12, to form a circuit loop, the combination of non-electrical connectors 21 and electrical conductors 13 to be divided into two parts, the first part being an electrical conductor 13 connect a lamp bulb 11, lamp base or lamp holder 12 with a hook 61 or hooks 61,62 on the upper part, the second part being a non-electrical connector 21 to be wound and twisted with another non-electrical connector 21 to form the twisted ropes 2, the electrical conductors 13 with the lamp bulbs 11, the lamp bases or lamp holders 12 in the first part to pass through the open part 24 of non-electrical connectors 21, an electrical conductor 13 intersected a non-electrical connector 21 from the open part 24, then pass through the hook 61 or respectively electrical conductors 13 passed through hooks 61,62, and the non-electrical connectors 21 due to a rebound force to make the open part 24 be shrunken so that the first part and the second part being fixed together whereby to form a safe lighting string.

Figure 6:
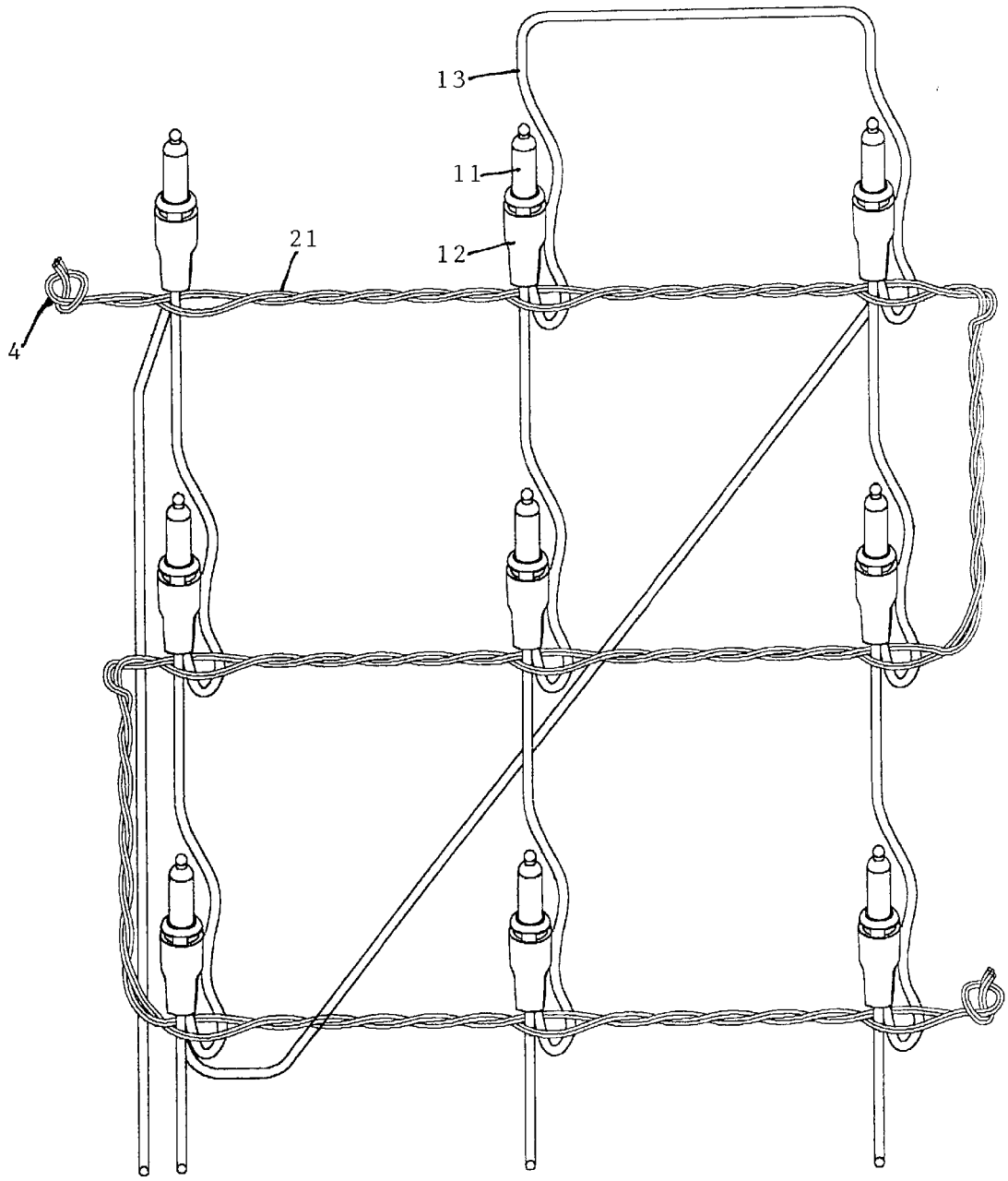
FIG. 6 is an embodiment of an electrical circuit distribution structure in the non-electrical connectors connected with electrical conductors to form a rectangular or square unit design of the present invention.

FIG. 6 is an embodiment of an electrical circuit distribution structure in the non-electrical connectors connected with electrical conductors to form a rectangular or square unit design of the present invention. It shows a decorative lighting string, the structure comprising a plurality of lamps, said lamps having lamp bulbs 11, lamp bases or lamp holders 12, multiple electrical conductors 13 and non-electrical connectors 21 with multiple bundle and twisted ropes formed by filaments to be wound and twisted into a small bundle line, then said lines having wound and twisted into a large rope to form non-electrical connectors, characterized in that the electrical conductors 13 being connected with lamp bulbs 11, lamp bases or lamp holders 12 to form a circuit loop, the combination of non-electrical connectors 21 and electrical conductors 13 being the electrical conductors 13 to be fixed to the non-electrical connectors 21 near to the position of lamp base or lamp holders 12 whereby to form a safe lighting string, said non-electrical connectors 21 being to fix a row of lamp bases or lamp holders 12, then at the end of the lamp bases or lamp holders 12 to follow the electrical conductor 13 up or down to fix another row of the lamp bases or lamp holders 12, with or without decorations on the non-electrical connectors 21 to form rhombic, rectangular or square form.

Figure 7:
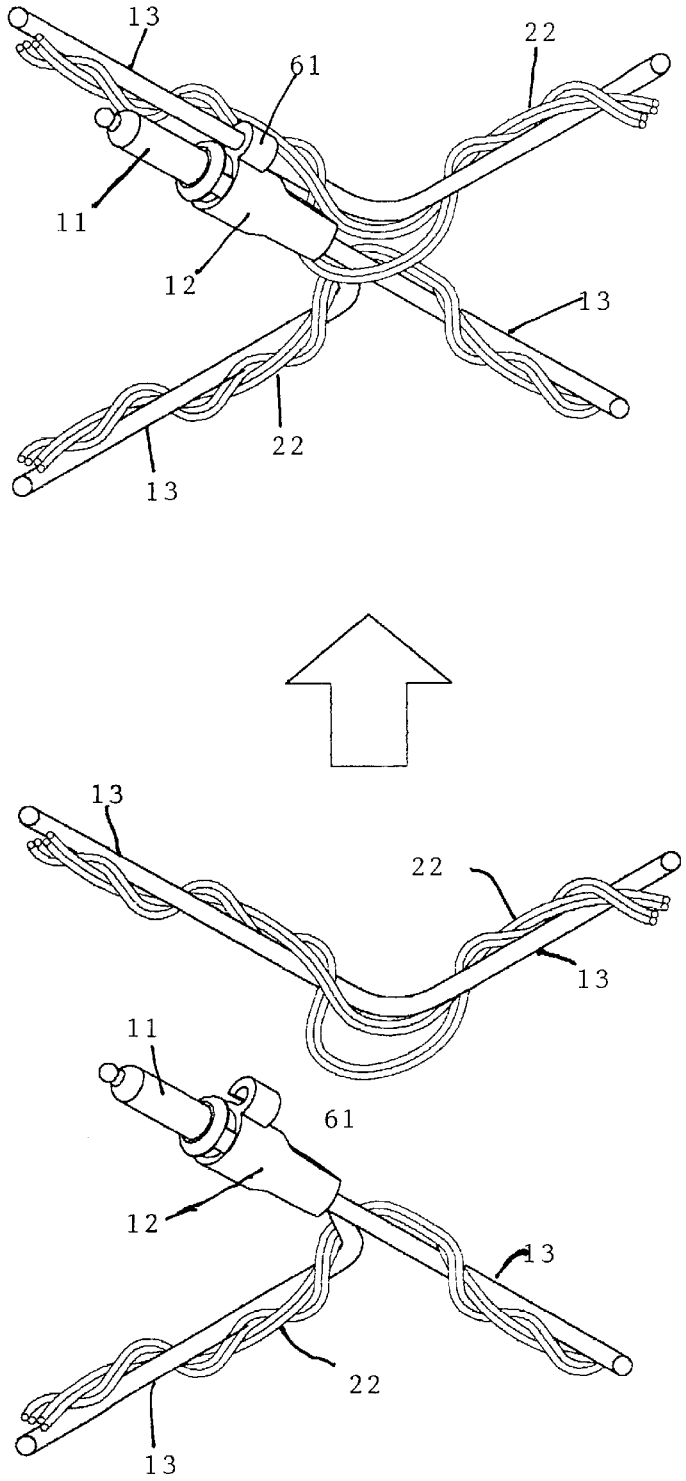
FIG. 7 is an embodiment of an electrical circuit distribution structure in the combination of electrical conductors with the non-electrical connectors of the present invention.

FIG. 7 is an embodiment of an electrical circuit distribution structure in the combination of electrical conductors with the non-electrical connectors. It shows that a method for forming an electrical circuit distribution structure for a decorative lighting string, wherein non-electrical connectors being formed by the ropes, said rope formed from filaments having wound and twisted into a small bundle line, then said lines being wound and twisted into a large rope, the combination of non-electrical connectors 22 and electrical conductors 13 to be divided into two parts, the first part being an electrical conductor 13 connect a lamp bulb 11, lamp base or lamp holder 12 with a hook 61 on the upper part to be wound and twisted with non-electrical connectors 22, the second part being an electrical conductor 13 to be wound and twisted with the wound and twisted non-electrical connectors 22, at proper intervals to form an obtuse angle and the non-electrical connectors 22 having an open part at the obtuse angle position, the first part of an electrical conductor 13 with lamp bulb 11, lamp base or lamp holder 12 with on hook 61 to pass through the open part of non-electrical connectors 22, the electrical conductor 13 in the second part to be fixed in the hook 61, the non-electrical connectors 22 in the second part due to a rebound force to make the open part be shrunken so that so that the first part and the second part being fixed together whereby to form a safe lighting string.

Figure 8:
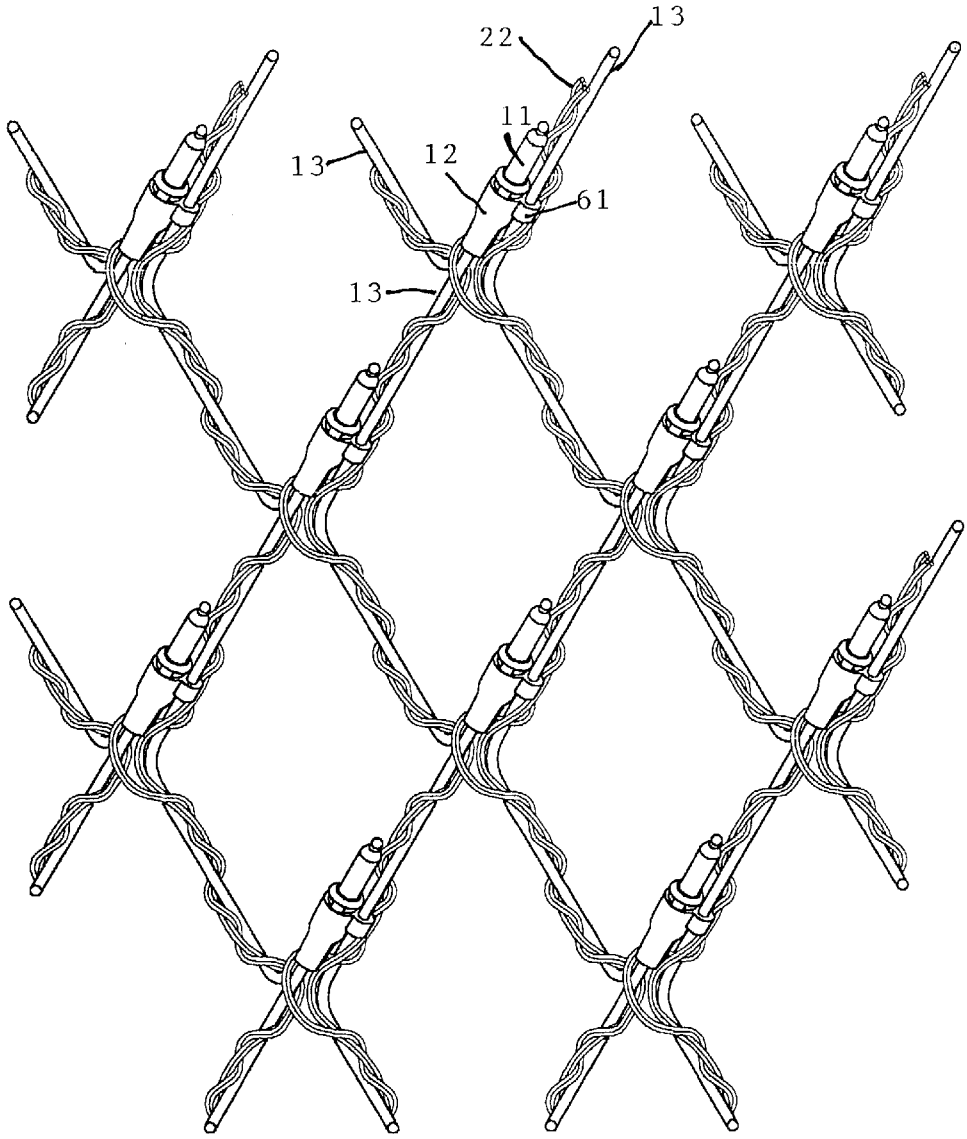
FIG. 8 is another embodiment of an electrical circuit distribution structure in rhombic unit to form a pyramid design of the present invention.

FIG. 8 is an embodiment of an electrical circuit distribution structure to form rhombic design. The combination of non-electrical connectors and electrical conductors is identical with those of in FIG. 7.

Figure 9:
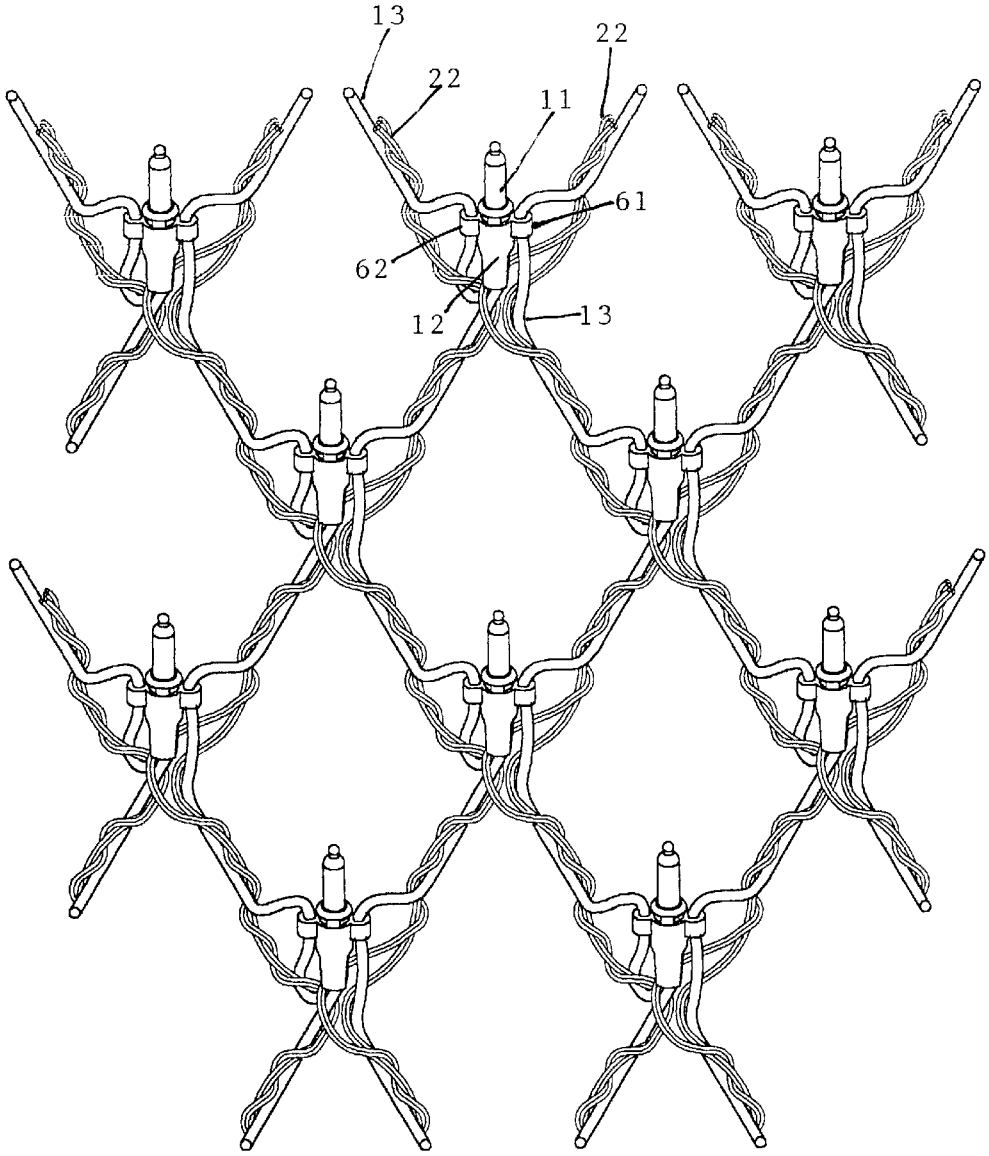
FIG. 9 is another embodiment of an electrical circuit distribution structure in rhombic unit of the present invention.
Figure 10:
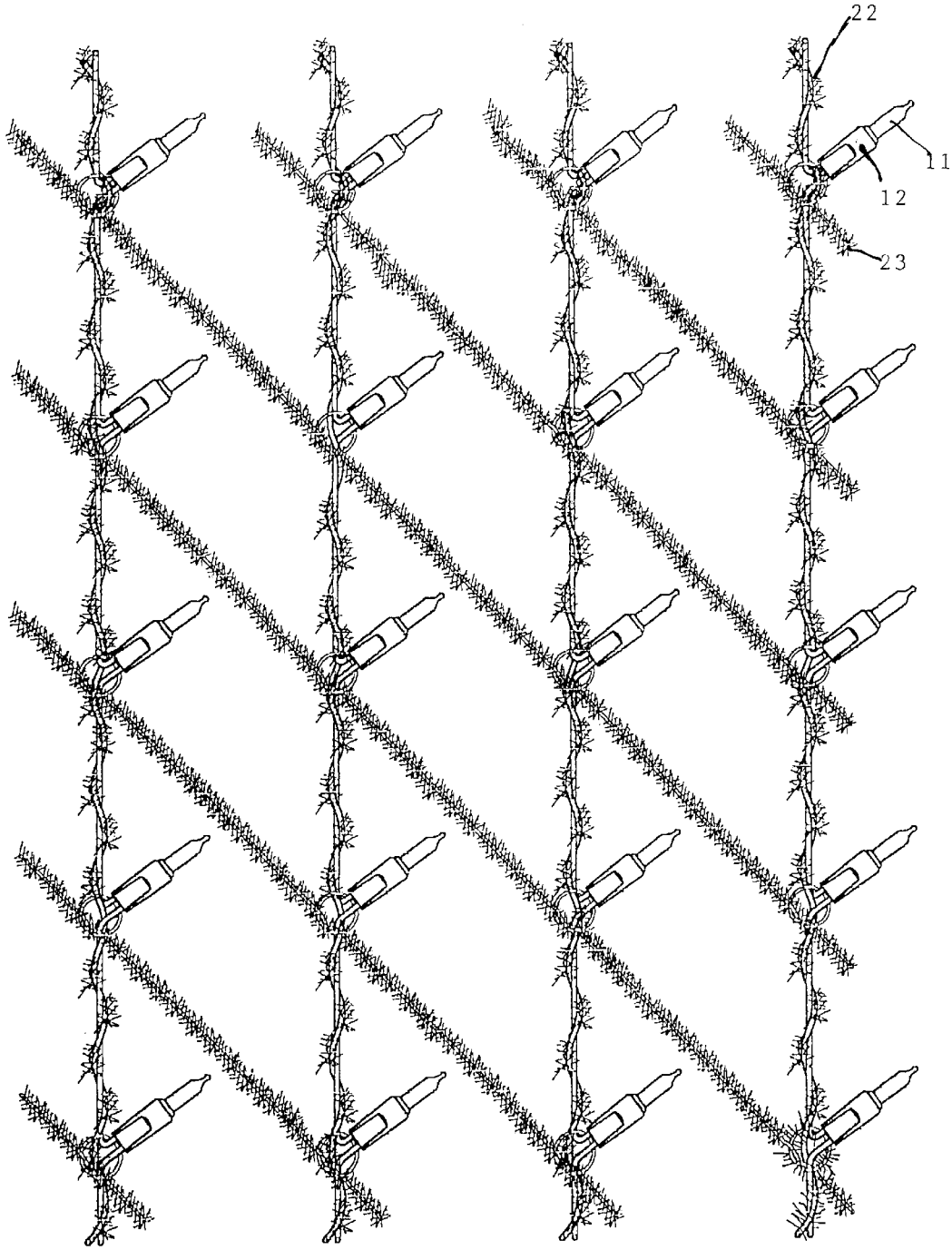
FIG. 10 is an embodiment of an electrical circuit distribution structure to use attached decoration of non-electrical connectors of the present invention.
Figures 11, 11B:
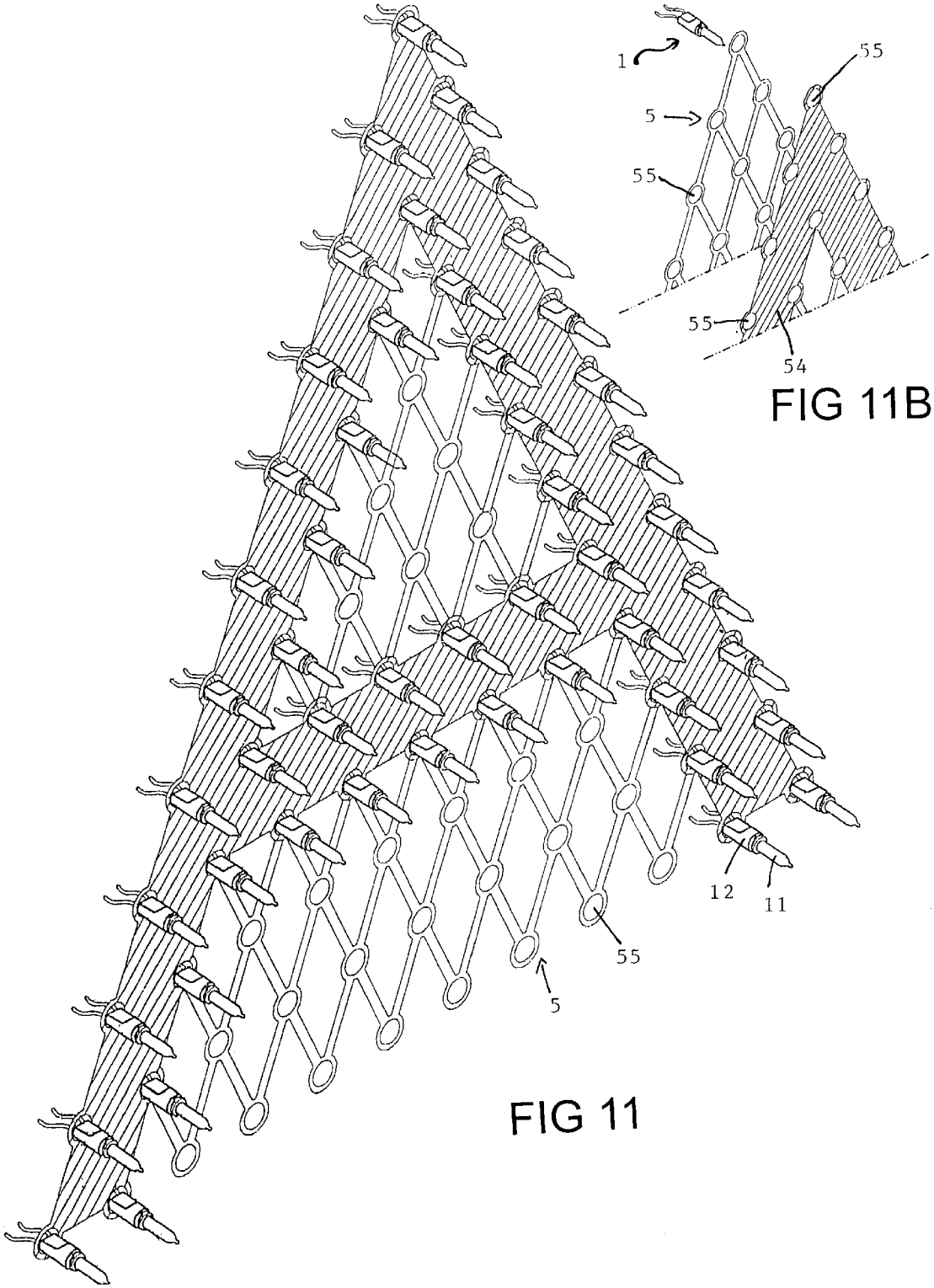
FIG. 11 is a further embodiment of an electrical circuit distribution structure in rhombic unit to form an A-type design of the present invention.
Figure 12B:
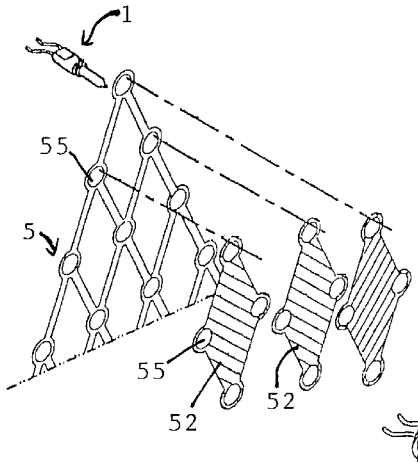
FIG. 12 is an embodiment of an electrical circuit distribution structure in rhombic unit to form an A-type design of the present invention.
FIG. 12A is a partial diagram of distribution.
Figure 12:
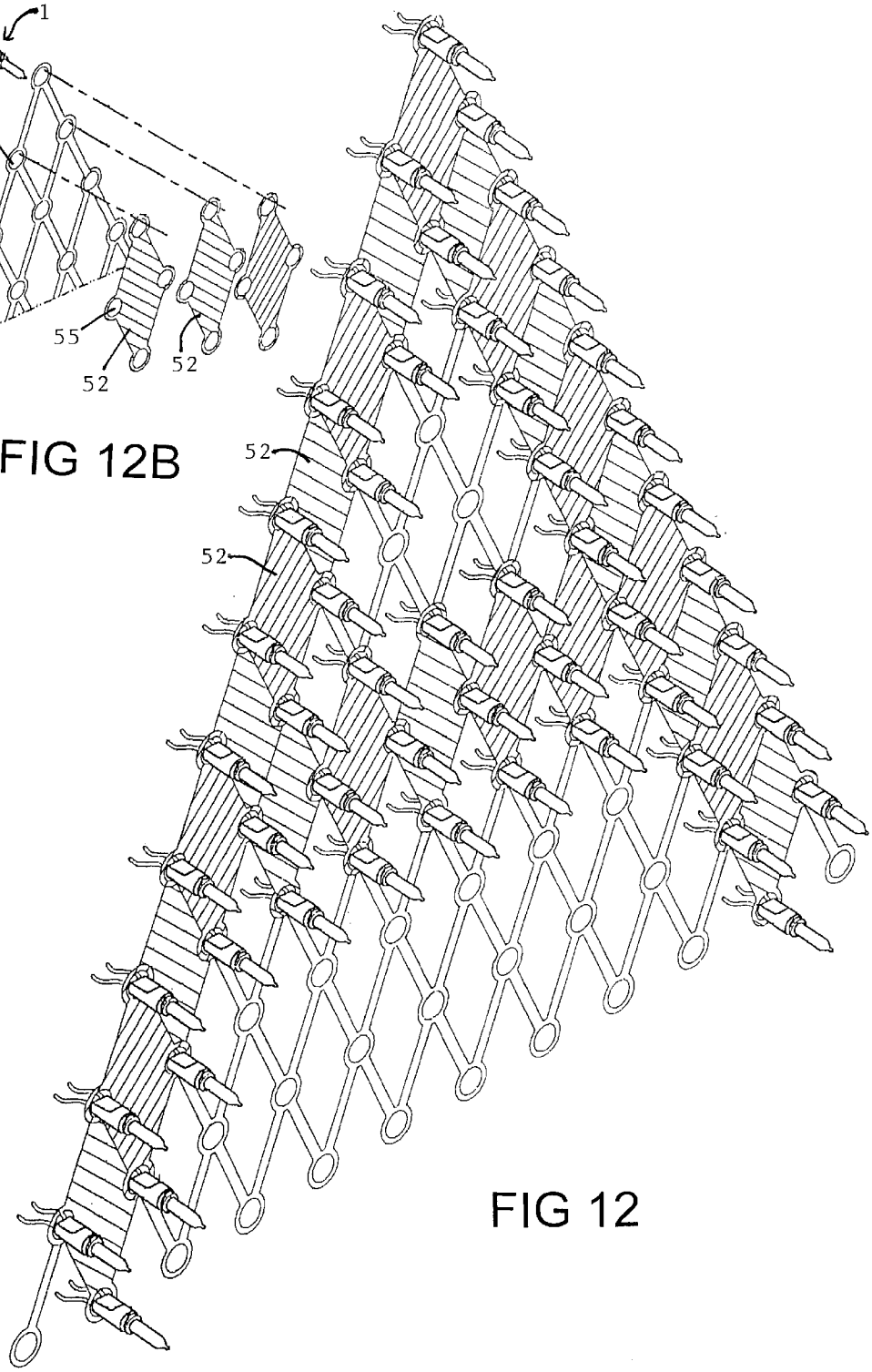

FIG. 9 is another embodiment of an electrical circuit distribution structure to form rhombic design. The combination of non-electrical connectors and electrical conductors is identical with those of in FIG. 7. However, the lamp bases or lamp holders 12 having hooks 61,62 on the upper side, and respectively electrical conductors 13 passed through hooks 61,62, FIG. 10 is an embodiment of an electrical circuit distribution structure to use attached decoration of non-electrical connectors of the present invention. Said non-electrical connectors attached decoration, such as golden scallions, to form non-electrical connectors with decoration 23. Such decorations accompanied in the structure of the present invention will be increasing decorative effect.

FIGS. 11, 11A, 12 and 12A are to use decorative sheets 5 with elasticity. The said decorative sheets are having several holes 55 and the diameter of the hole is slightly small than outer diameter of lamp base or lamp holder 12; or the rhombic decorative sheets 52 are used, and their four corners respectively make holes 55; or whole bulk of A-type decorative sheets are used, and a rhombic is formed between four holes, the intervals of said holes are same as those of lamp bulbs 11 of rhombic unit 32 of lighting string. Each of hole 55 in the decorative sheets 5 is put in the corresponding lamp bulbs 11 and lamp bases or lamp holders 12, and the decorative sheets 5 are fastened and fixed between the lamp bases or lamp holders 12 and electrical conductors 13, or non-electrical connectors 21 or non-electrical connectors 22 (the symbol of 13, 21 and 22 not shown in the drawings). Thus A-type design is the combination of single layer such as decorative 5 or rhombic decorative sheet 52, or multiple layers such as decorative sheet 5 and rhombic decorative sheet 52, the same or different color decorative sheets.

Figure 13:
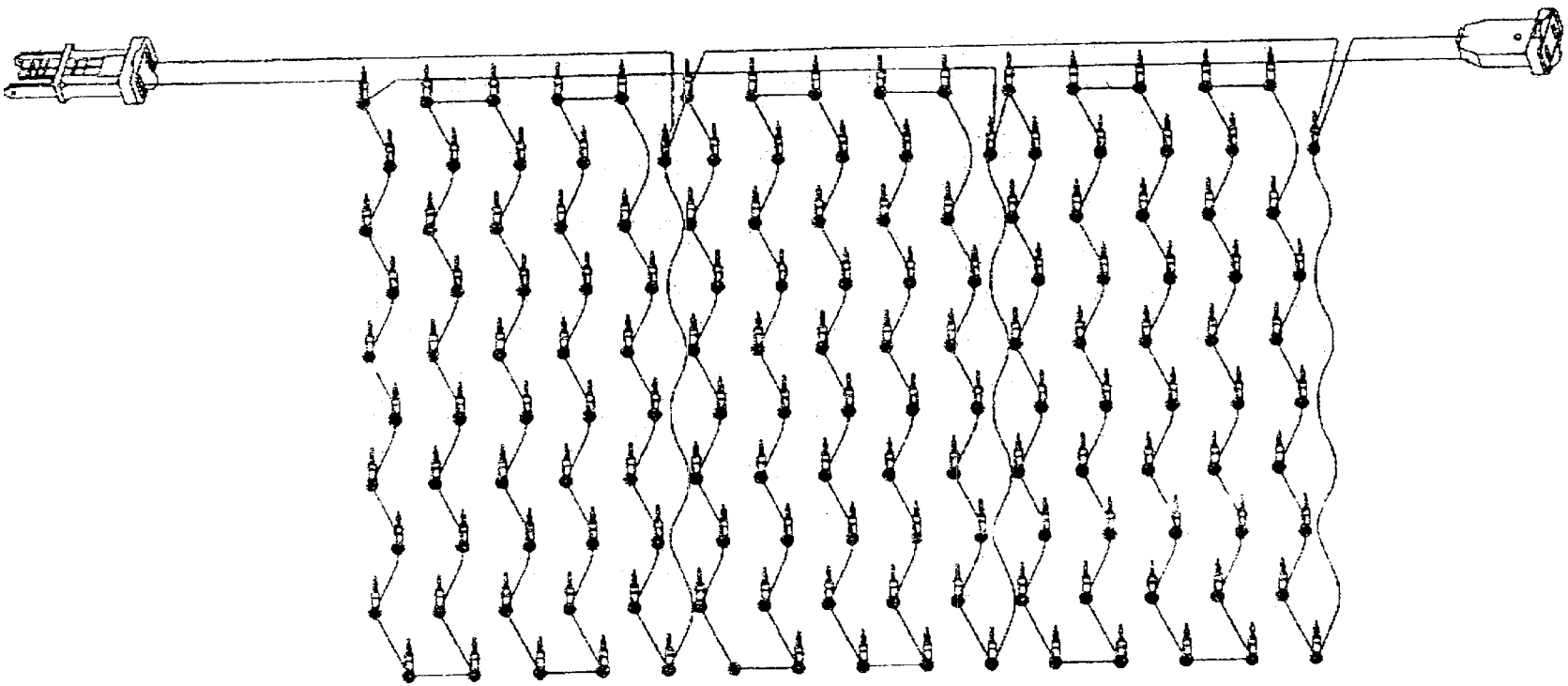
FIG. 13 is an embodiment of an electrical circuit distribution structure in a curtain type design with electrical conductors wires of the present invention.

FIG. 13 is an embodiment of an electrical circuit distribution structure in curtain type design with electrical conductors wires of the present invention. The formation of the structure is identical with that of in FIG. 1 and the wires of the curtain type are all formed by electrical connectors.

Figure 14:
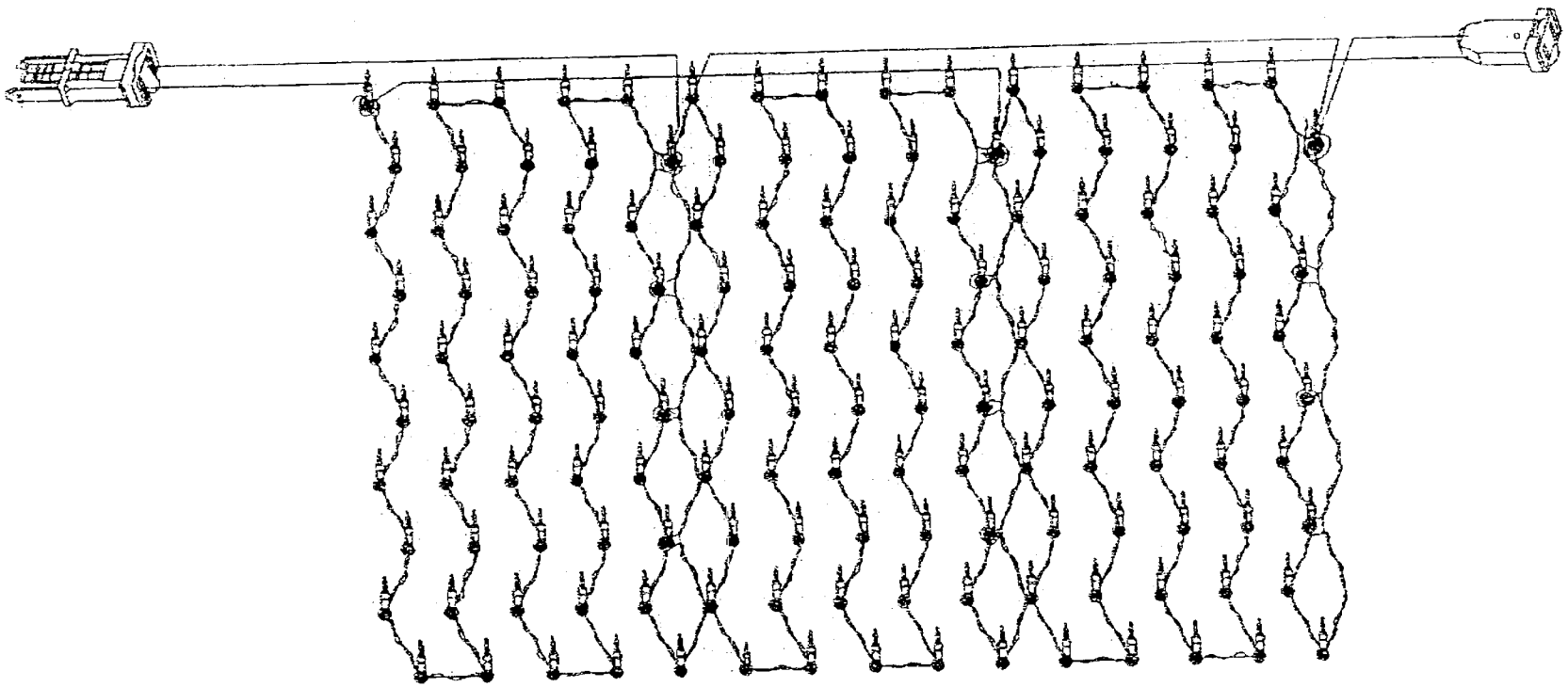
FIG. 14 is a further embodiment of an electrical circuit distribution structure in a curtain type design with the combination of electrical conductors with a non-electrical connector being wound and twisted form of the present invention.

FIG. 14 is a further embodiment of an electrical circuit distribution structure in curtain type design with the combination of electrical conductors with non-electrical connector being wound and twisted form of the present invention. The formation of the structure is identical with that of in FIG. 1 and the wires of the curtain type are all formed by electrical connectors and non-electrical connectors. The combination of non-electrical connectors and electrical conductors to be wound each other to form the twisted lines, the end of the electrical conductors to be fixed to the electrical conductors by making knots where by to form a safe lighting string.

Figure 15:
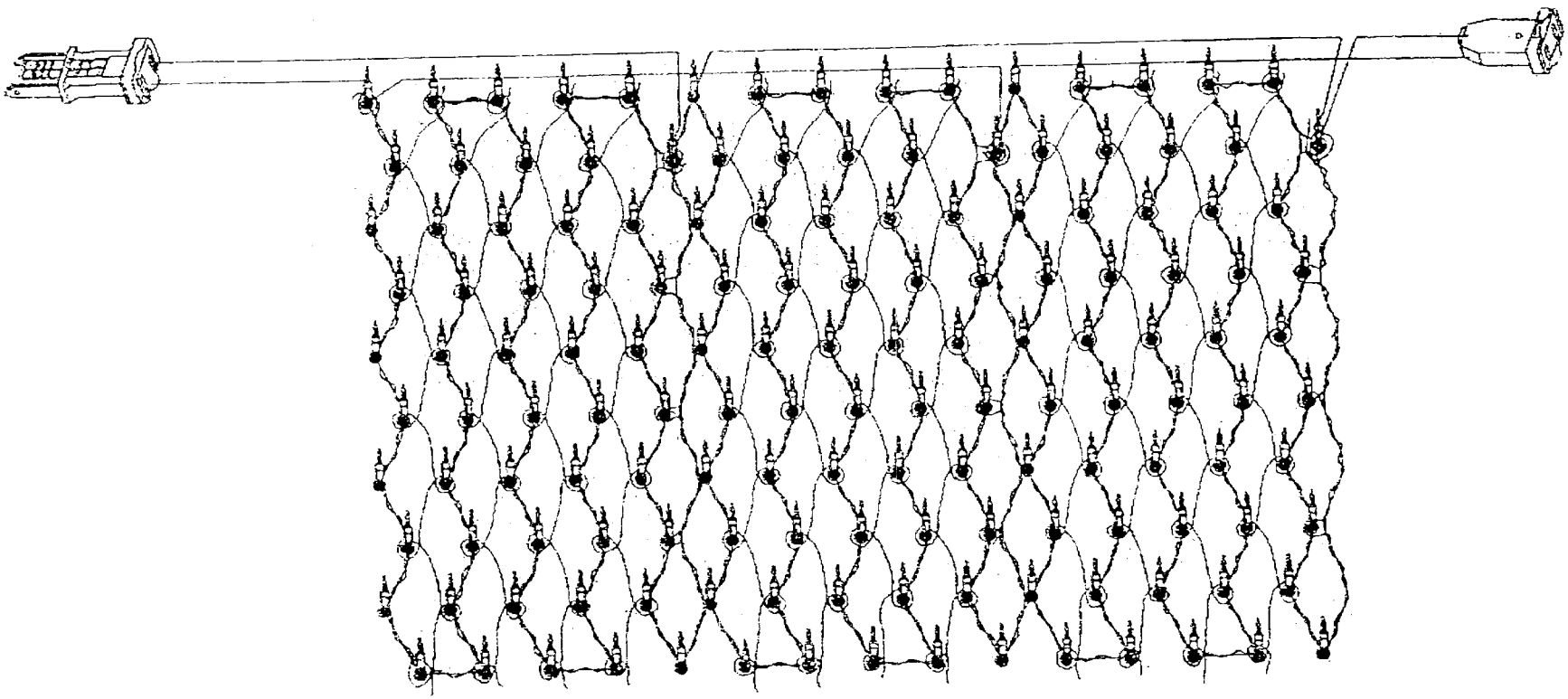
FIG. 15 is an embodiment of an electrical circuit distribution structure in a web-net type design with the combination of electrical conductors with a non-electrical connector being wound and twisted form of the present invention.

FIG. 15 is an embodiment of an electrical circuit distribution structure in web-net type design with the combination of electrical conductors with non-electrical connector being wound and twisted form of the present invention. The combination of non-electrical connectors and electrical conductors being the electrical conductors to be fixed to the non-electrical connectors near to the position of lamp base or lamp holders by making a knot whereby to form a safe lighting string in web-net shape.

Figure 16:
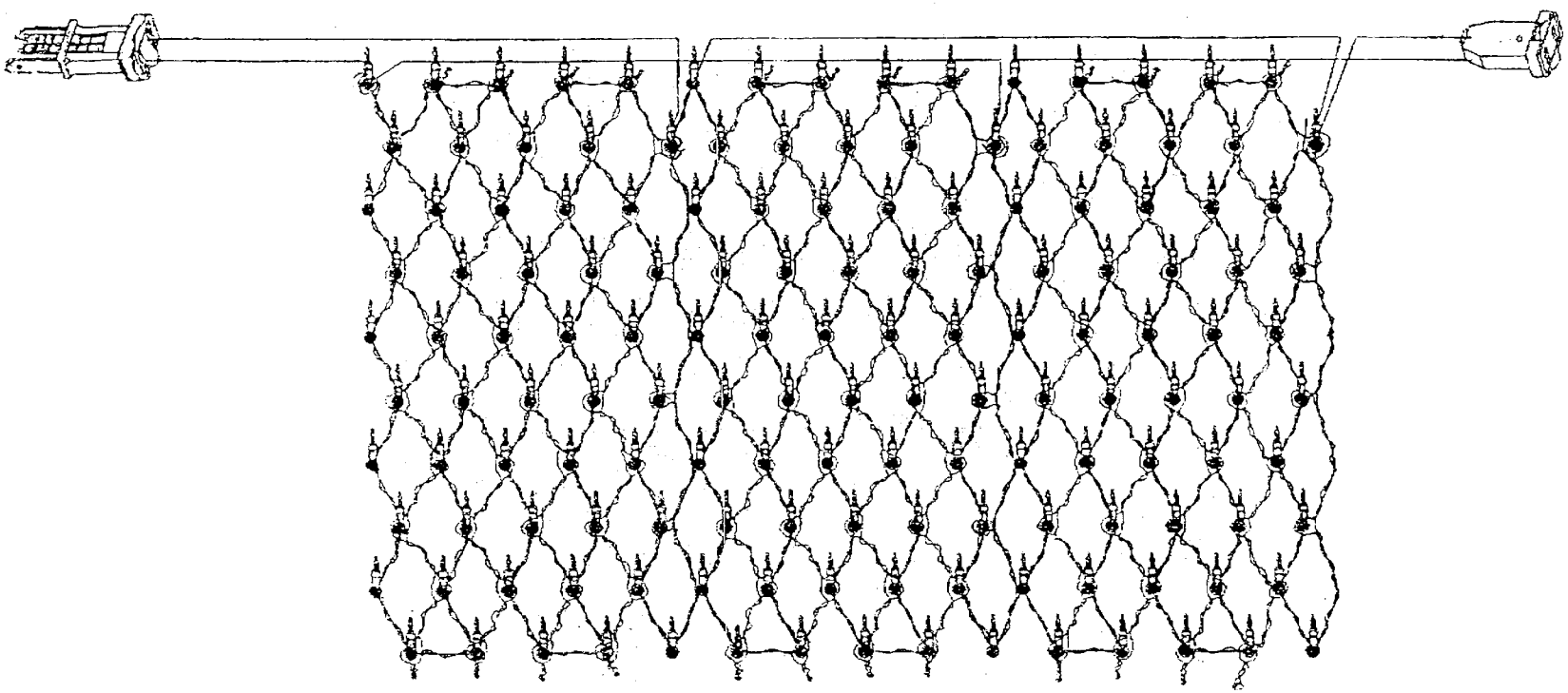
FIG. 16 is a further embodiment of an electrical circuit distribution structure in a web-net type design with the combination of electrical conductors with a non-electrical connector being wound and twisted form of the present invention.

FIG. 16 is a further embodiment of an electrical circuit distribution structure in web-net type design with the combination of electrical conductors with non-electrical connector being wound and twisted form of the present invention. The non-electrical connectors are formed by the ropes, said rope formed from filaments having wound and twisted into a small bundle line, then said lines being wound and twisted into a large rope, said twisted rope to use a reversing force to form an open part at intervals to accept electrical conductors with the lamp bulbs, the lamp bases or lamp holders to pass through its open part, while an electrical conductor intersected from the open part, due to a rebound force to make the open part be shrunken so that electrical conductors with the lamp bulbs, the lamp bases or lamp holders being fixed together whereby to form web-net shape in the safe lighting string. The combination of the electrical conductors and non-electrical connectors is identical that of in FIG. 2.

Further, the methods for making knots are various. For the convenience of reference, there are seven kinds of methods to be introduced in the present invention. In sequence, a cow hitch, a clove hitch, a half knots, a loop knot, a fisherman's bend, a sailor's hitch and a marlinespike hitch are able to be used in the present invention.

The features and preferred embodiments of the present invention have been described in the foregoing specification. The invention intended to be protected herein, however, is not to be construed as limited to the particular forms disclosed. Variations and changes, which maybe made by those skilled in the art, are with out departing form the scope of the present invention.

What is claimed is:

1. An electrical circuit distribution structure for a decorative lighting string, the structure comprising a plurality of lamps, a plurality of electrical conductors connecting said lamps, and non-electrical connectors, each of said nonelectrical connectors comprising plural lines with each line formed of wound and twisted filaments, said lines being twisted into said non-electrical connectors, at least one of said lamps being passed between two lines of one of said non-electrical connectors with said two lines of said non-electrical connectors extending twisted in each direction from said one of said lamps passed between said two lines to provide a connection of said plurality of electrical conductors and said non-electrical connectors to form triangular, rhombic, rectangular or square forms.

2. An electrical circuit distribution structure for a decorative lighting string as claimed in claim 1, wherein said lamps have lamp bulbs, lamp bases or lamp holders, each of said lamp holders having an upper side with a hook or two hooks.

3. An electrical circuit distribution structure for a decorative lighting string as claimed in claim 1, wherein said non-electrical connectors with filaments wound and twisted into lines include a multiplicity of lines wound and twisted into a large rope structure.

4. An electrical circuit distribution structure for a decorative lighting string as claimed in claim 1, further comprising a plug and/or a socket and a flasher control.

5. An electrical circuit distribution structure for a decorative lighting string as claimed in claim 1, wherein lamps are passed between said two twisted lines at intervals the lamps being disposed spaced at intervals to form identical or different appearance and also being fixed to said non-electrical connectors and arranged to form a certain appearance, design or word.

6. An electrical circuit distribution structure for a decorative lighting string as claimed in claim 1, further comprising one of an electrical conductor and a non-electrical connector crossing with a vertical, horizontal or inclined direction with respect to said connection of said plurality of electrical conductors and said non-electrical connectors to form a final appearance.

7. An electrical circuit distribution structure for a decorative lighting string as claimed in claim 1, wherein at least one of said non-electrical connectors has attached decorations, said decorations being connected and arranged into a certain appearance, design or words and to obtain a decorative effect.

8. An electrical circuit distribution structure for a decorative lighting string as claimed in claim 7, wherein said, wherein said lamps have lamp bulbs, lamp bases or lamp holders and said decorations have holes, the intervals of said holes being the same as the interval of lamp bases or lamp holders, said lamp bases or lamp holders being put into the holes, the decorations being fastened and fixed at the lamp bases or lamp holders so as to increase a decorative effect.

9. An electrical circuit distribution structure for a decorative lighting string as claimed in claim 7, wherein said decorations comprise two or more than two decorative elements with identical or different colors.

10. An electrical circuit distribution structure for a decorative lighting string as claimed in claim 1, wherein decorations are one of a triangular, rhombic, rectangular, square or irregular form.

11. An electrical circuit distribution structure for a decorative lighting string as claimed in claim 7, wherein said decorations comprise scallions and filaments twisted together on the non-electrical connectors.

12. An electrical circuit distribution structure for a decorative lighting string, the structure comprising a plurality of lamps, said lamps having lamp bulbs, lamp bases or lamp holders, multiple electrical conductors and non-electrical connectors, each of said non-electrical connectors comprising filaments wound and twisted into a line with a plurality of said lines being twisted to form said non-electrical connectors, said electrical conductors being connected with lamp bulbs, a receptacle and a flasher control to form a circuit loop, each of said non-electrical connectors being connected to at least one of said electrical conductors fixed near to a position of a lamp base or lamp holder whereby to form a safe lighting string in series, parallel or series and parallel, said nonelectrical connectors being to fix a row of lamp bases or lamp holders, then at the end of the lamp bases or lamp holders to follow the electrical conductor up or down to fix another row of the lamp bases or lamp holders, with or without decorations on the nonelectrical connectors to form rhombic, rectangular or square form.

13. An electrical circuit distribution structure for a decorative lighting string according to claim 12, further comprising decorations, said non-electrical connectors having said decorations attached thereto, said decorations being connected and arranged into a certain appearance, design or words and to obtain a decorative effect.

14. An electrical circuit distribution structure for a decorative lighting string as claimed in claim 13 wherein said lamp bases or lamp holders have a hook or two hooks on the upper side.

15. An electrical circuit distribution structure for a decorative lighting string as claimed in claim 13, wherein said non-electrical connectors comprise a multiplicity of said lines wound and twisted into a large rope.

16. An electrical circuit distribution structure for a decorative lighting string as claimed in claim 13, further comprising a receptacle and a flasher control.

17. An electrical circuit distribution structure for a decorative lighting string as claimed in claim 13, wherein said non-electrical connectors with multiple lines forming twisted ropes at proper intervals are fixed with electrical conductors near to the position of lamp bases or lamp holders, the lamp bases or lamp holders being limited in proper spaced at intervals to form identical or different appearance, then to be wound and twisted and arranged to form a certain appearance, design or words.

18. An electrical circuit distribution structure for a decorative lighting string as claimed in claim 13, wherein electrical conductors and non-electrical connectors are simultaneously or individually crossed each other with vertical, horizontal or inclined directions to form every appearance.

19. An electrical circuit distribution structure for a decorative lighting string as claimed in claim 13, wherein decorations having holes, the intervals of said holes are same as those of lamp bases or lamp holders, the said lamp bases or lamp holders being passed into the holes, the decorations being fastened and fixed at the lamp bases or lamp holders so as to increase a decorative effect.

20. An electrical circuit distribution structure for a decorative lighting string as claimed in claim 19, wherein said decorations comprise two or more than two with identical or different colors.

21. An electrical circuit distribution structure for a decorative lighting string as claimed in claim 20, wherein said decorations are triangular, rhombic, rectangular, square or irregular in form.

22. An electrical circuit distribution structure for a decorative lighting string as claimed in claim 21, wherein said decorations are connected and arranged into a certain appearance, design or words and to obtain a decorative effect.

23. An electrical circuit distribution structure for a decorative lighting string as claimed in claim 22, wherein said decorations comprise scallions and filaments twisted together on said non-electrical connectors.

24. An electrical circuit distribution structure for a decorative lighting string, the structure comprising a plurality of lamps, said lamps having lamp bulbs, lamp bases or lamp holders, multiple electrical conductors and non-electrical connectors with multiple bundle and twisted ropes formed by filaments to be wound and twisted into a small bundle line, then said lines having wound and twisted into a large rope to form non-electrical connectors, characterized in that the electrical conductors being connected with lamp bulbs, lamp bases or lamp holders, receptacles and flasher control to form a circuit loop, the combination of non-electrical connectors and electrical conductors being the electrical conductors to be fixed to the non-electrical connectors near to the position of lamp base or lamp holders whereby to form a safe lighting string in series, parallel or series and parallel, said non-electrical connectors being to fix a row of lamp bases or lamp holders, then at the end of the lamp bases or lamp holders to follow the electrical conductor up or down to fix another row of the lamp bases or lamp holders, with or without decorations on the non-electrical connectors.

25. An electrical circuit distribution structure for a decorative lighting string as claimed in claim 24, wherein said lamp bases or lamp holders having a hook or two hooks on the upper side or without hook.

26. An electrical circuit distribution structure for a decorative lighting string as claimed in claim 24, wherein said non-electrical connectors with multiple bundle and twisted ropes, said rope formed with filaments having wound and twisted into a small bundle line, then said lines being wound and twisted into a large rope to form a non-electrical connector.

27. An electrical circuit distribution structure for a decorative lighting string as claimed in claim 24, wherein said structure having receptacles and flasher control.

28. An electrical circuit distribution structure for a decorative lighting string as claimed in claim 24, wherein using non-electrical connectors with multiple bundle and twisted ropes at proper intervals fixed with electrical conductors near to the position of lamp bases or lamp holders, the lamp bases or lamp holders being limited in proper spaced at intervals to form triangular, rhombic, rectangular, square or irregular forms, said non-electrical connectors having attached decorations, said decorations being connected and arranged into a certain appearance or design to obtain a decorative effect.

29. An electrical circuit distribution structure for a decorative lighting string as claimed in claim 24, wherein using electrical conductors and non-electrical connectors being simultaneously or individually crossed each other with vertical, horizontal or inclined directions to form every appearance.

30. An electrical circuit distribution structure for a decorative lighting string as claimed in claim 24, wherein using non-electrical connectors having attached decorations, said decorations being connected and arranged into a certain appearance, design or words and to obtain a decorative effect.

31. An electrical circuit distribution structure for a decorative lighting string as claimed in claim 30, wherein the decoration being scallions and filaments twisted together on the non-electrical connectors.

32. An electrical circuit distribution structure for a decorative lighting string as claimed in claim 24, wherein decorations having holes, the intervals of said holes are same as those of lamp bases or lamp holders, the said lamp bases or lamp holders to be put into the holes, the decorations being fastened and fixed at the lamp bases or lamp holders so as to increase a decorative effect.

33. An electrical circuit distribution structure for a decorative lighting string as claimed in claim 32, wherein decorations being two or more than two with identical or different colors.

34. An electrical circuit distribution structure for a decorative lighting string as claimed in claim 32, wherein decorations being triangular, rhombic, rectangular, square or irregular form.

35. A method for forming an electrical circuit distribution structure for a decorative lighting string comprising lamp bulbs, lamp bases or lamp holders having a hook or two hooks or without hook, multiple electrical conductors, receptacles, flasher control and non-electrical connectors with multiple bundle and twisted lines, characterized in that the electrical conductors being connected with lamp bulbs, lamp bases or lamp holders, receptacles and flasher control to form a circuit loop, the combination of non-electrical connectors and electrical conductors to be divided into two parts, the first part being an electrical conductor to be wound and twisted with non-electrical connectors to form the twisted lines, the second part being a non-electrical connector to be wound and twisted with non-electrical connector each other to form the twisted lines, the electrical conductors with the lamp bases or lamp holders in the first part to be fixed in the hook to pass through the open part of non-electrical connectors so that the first part and the second part being fixed together whereby to form a safe lighting string in series, parallel or series and parallel.

36. A method for forming an electrical circuit distribution structure for a decorative lighting string, wherein non-electrical connectors being formed by the ropes, said rope formed from filaments having wound and twisted into a small bundle line, then said lines being wound and twisted into a large rope, the combination of non-electrical connectors and electrical conductors to be divided into two parts, the first part being an electrical conductor connect a lamp bulb, lamp base or lamp holder with a hook on the upper part, the second part being a non-electrical connector to be wound and twisted with another non-electrical connector to form the twisted ropes, the electrical conductors with the lamp bulbs, the lamp bases or lamp holders in the first part to pass through the open part of non-electrical connectors, an electrical conductor intersected a non-electrical connector from the open part, then pass through the hook, and the non-electrical connectors due to a rebound force to make the open part be shrunken so that the first part and the second part being fixed together whereby to form a safe lighting string in series, parallel or series and parallel.

37. A method as claimed in claim 36, wherein the structure being a triangular, rhombic, rectangular, square or irregular form.

38. A method for forming an electrical circuit distribution structure for a decorative lighting string, wherein non-electrical connectors being formed by the ropes, said rope formed from filaments having wound and twisted into a small bundle line, then said lines being wound and twisted into a large rope, the combination of non-electrical connectors and electrical conductors to be divided into two parts, the first part being an electrical conductor connect a lamp bulb, lamp base or lamp holder with a hook on the upper part to be wound and twisted with non-electrical connectors, the second part being an electrical conductor to be wound and twisted with the wound and twisted non-electrical connectors, at proper intervals to form an obtuse angle and the non-electrical connectors having an open an open part at the obtuse angle position, the first part of an electrical conductor with lamp bulb, lamp base or lamp holder with on hook or hooks to pass through the open part of non-electrical connectors, the electrical conductor in the second part to be fixed in the hook, the non-electrical connectors in the second part due to a rebound force to make the open part be shrunken so that so that the first part and the second part being fixed together whereby to form a safe lighting string in series, parallel or series and parallel.

39. A method as claimed in claim 38, wherein the structure being a triangular, rhombic, rectangular, square or irregular form.

* * * * *